US007924159B2

(12) United States Patent
Ota et al.

(10) Patent No.: US 7,924,159 B2
(45) Date of Patent: Apr. 12, 2011

(54) REMOTE WAFER PRESENCE DETECTION WITH PASSIVE RFID

(75) Inventors: Kan Ota, Bedford, MA (US); Michael Chen, Danvers, MA (US); David K. Bernhardt, Hudson, MA (US)

(73) Assignee: Axcelis Technologies Inc., Beverly, MA (US)

( * ) Notice: Subject to any disclaimer, the term of this patent is extended or adjusted under 35 U.S.C. 154(b) by 425 days.

(21) Appl. No.: 12/022,300

(22) Filed: Jan. 30, 2008

(65) Prior Publication Data

US 2009/0189766 A1 Jul. 30, 2009

(51) Int. Cl.
*G08B 13/14* (2006.01)

(52) U.S. Cl. ..... 340/572.1; 438/480; 438/506; 438/514

(58) Field of Classification Search ..... 340/572.1; 414/729, 730; 294/1, 9.1, 902; 29/825; 438/106–108, 480, 506, 514, 520; 250/492.21, 250/492.2, 398
See application file for complete search history.

(56) References Cited

U.S. PATENT DOCUMENTS

| | | | | |
|---|---|---|---|---|
| 4,813,732 | A * | 3/1989 | Klem | 294/103.1 |
| 6,918,735 | B2 * | 7/2005 | Urban et al. | 414/729 |
| 7,135,691 | B2 | 11/2006 | Vanderpot et al. | |
| 7,141,809 | B2 | 11/2006 | Vanderpot et al. | |
| 2008/0131239 | A1 * | 6/2008 | Rebstock | 414/225.01 |
| 2008/0292432 | A1 * | 11/2008 | Castantini et al. | 414/217.1 |

* cited by examiner

*Primary Examiner* — George A Bugg
*Assistant Examiner* — Hongmin Fan
(74) *Attorney, Agent, or Firm* — Eschweiler & Associates, LLC

(57) ABSTRACT

The present invention involves a system and method of remotely detecting the presence of a wafer comprising, a passive RFID circuit, wherein the RFID circuit is attached to an end of a transfer arm located inside a vacuum chamber of an ion implantation system, a reader located outside the vacuum chamber, and wherein the RFID tag provides an indication relating to whether or not a wafer is secured by the transfer arm.

25 Claims, 13 Drawing Sheets

REMOTE WAFER PRESENCE DETECTION WITH PASSIVE RFID

FIELD OF INVENTION

The present invention relates generally to a remote wafer detection system and method, and more particularly to a remote wafer detection system and method for utilizing passive RFID tags in ion implantation systems.

BACKGROUND OF THE INVENTION

Ion implantation systems are sophisticated systems that are employed in fabricating semiconductor devices including flash memory, system on chip devices, central processor units, and the like. Ion implantation systems are employed during semiconductor device fabrication to selectively implant ions and control device behavior in a process referred to as ion implantation. Ion implantation systems rely on proper performance of their constituent parts in order to properly perform ion implantation and, as a result, properly fabricate semiconductor devices.

Shortening cycle times to fabricate semiconductors is critical to the success of semiconductor manufacturing. A key factor in cycle time is the movement of semiconductor workpieces from the equipment front end module (EFEM), at ambient pressure, into a load lock area, for vacuum pump down, and subsequently into the vacuum processing chamber, for example. Shortened cycle times are critical to operational success allowing lean manufacturing, lean inventory, better yields, less equipment downtime, and the like. One method of shortening cycle times involves adding wafer presence detection into the wafer handling system. This allows the system to proceed from one step to the next as soon as it has validated the presence or absence of a wafer.

In addition to shortening cycle times, wafer presence detection allows the wafer handling system to "recognize" when a wafer has been dropped or mishandled, so that the system can be interrupted, an operator can be notified, and the like. Without such "recognition", wafers can be dropped or mishandled and can cause extensive damage to the system. This can cause contamination to subsequent wafers, result in reduced production yields, take a system out of production, result in costly repairs, etc.

Although there are many benefits to adding wafer presence detection in the wafer handling system, wiring a sensor to a power supply within the vacuum processing chamber significantly increases the complexity of the detection system. For example, adding powered wafer presence detection sensors to the wafer transfer arm would require major design changes. Thus, it is desirable to provide a method for allowing the remote detection of wafers within the vacuum processing chamber that does not require a dedicated power supply in the vacuum chamber.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

The present invention facilitates semiconductor device fabrication and ion implantation by providing systems and methods for managing and/or authenticating the presence of wafers within a system. The present invention includes methods that seek signals from components, including subsystems before, during, and after operation. Passive RFID tags can be associated with the presence of wafers and provide signals, which are then employed to authenticate detection and proper engagement of the components within the system. Additionally, the RFID tags can also be employed with the present invention to identify components, manage components within a system, track part/component usage, and the like.

The RFID tags generally store and transmit at least a part number and/or a serial number when excited. One or more readers can be present outside the vacuum chamber and communicate with the RFID tags via a wireless communication medium. A controller generates interrogatory signals, receives response signals from the RFID tags, and employs the received response signals to authenticate the wafers are properly engaged for transport and handling.

The present invention provides a method of remotely detecting a wafer comprising, a passive RFID circuit, wherein the RFID circuit is attached to an end of a transfer arm located inside a vacuum chamber of an ion implantation system, a reader located outside the vacuum chamber, and wherein the RFID tag provides an indication relating to whether or not a wafer is secured by the transfer arm.

The present invention in another embodiment provides a remote wafer detection system, comprising a passive RFID circuit, wherein the RFID circuit is attached to an end of a transfer arm located inside a vacuum chamber of an ion implantation system, a reader located outside the vacuum chamber; and wherein the RFID tag provides a signal related to whether or not a wafer is properly gripped by the transfer arm.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

Figure 1:
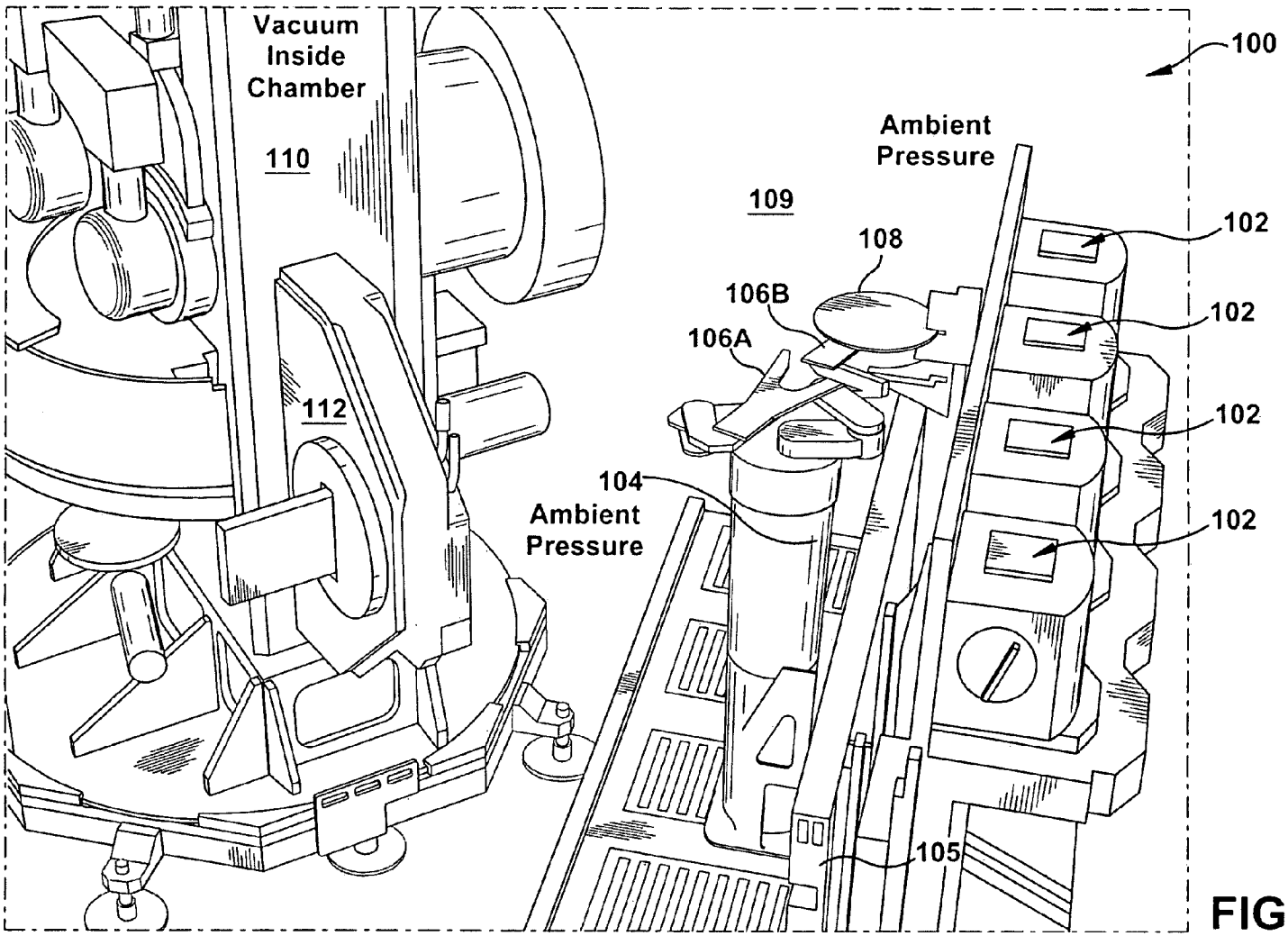
FIG. 1 illustrates an exemplary ion implantation system that includes robotic transfer of wafers in accordance with an aspect of the present invention.

The present invention will now be described with reference to the attached drawings, wherein like reference numerals are used to refer to like elements throughout. It will be appreciated by those skilled in the art that the invention is not limited to the exemplary implementations and aspects illustrated and described hereinafter.

The present invention facilitates ion implantation systems by remotely detecting a wafer and/or component pick-up, grasping, and the like, in an ion implantation system, for example. The present invention can allow operation of the ion implantation system, operate the system in a safe mode, or prevent operation of the system according to the lack of detected wafers and/or components.

The present invention facilitates operation of systems by managing and ensuring wafers present within a system. The present invention includes passive RFID tags individually associated with the transfer arm transferring wafers within the system. The passive RFID tags generally receive and/or transmit data when they are activated by an RFID reader (transceiver). One or more readers are present and communicate with the RFID tags via a wireless communication medium. A controller can generate a signal, receive a response signal from the RFID tags, and employ the received response signal to authenticate the presence and proper gripping of a wafer and/or component within the vacuum chamber, determine a gripping force, and the like, for example.

FIG. 1 is an overview illustration of an ion implantation system 100 in accordance with an aspect of the present invention. The system can, for example, be employed with a wafer detection system within the ion implantation system 100. The system 100 as shown is lacking various shrouds and components for the sake of clarity. The system 100 includes four wafer storage pods 102, a robot 104 with a first robotic arm 106A and a second robotic arm 106B for moving silicon wafers 108, into and out of the vacuum processing chamber 110. The robot 104 can translate and rotate with respect to a fixture 105. The outer walls or shroud of an equipment front end module (EFEM) 109 and the vacuum chamber 110 shroud, as discussed supra, are not shown for clarity. In addition, the vacuum processing chamber 110 can rotate with respect to the fixture 105 to facilitate loading and unloading of wafers. The equipment front end module 109 is typically at ambient pressure, for example. The wafers 108 can be moved into the vacuum chamber 110 through a vacuum load lock 112, of the system 100. The wafers 108 are introduced into the load lock 112 at ambient pressure where a vacuum is pulled on the load lock 112.

Figure 2:
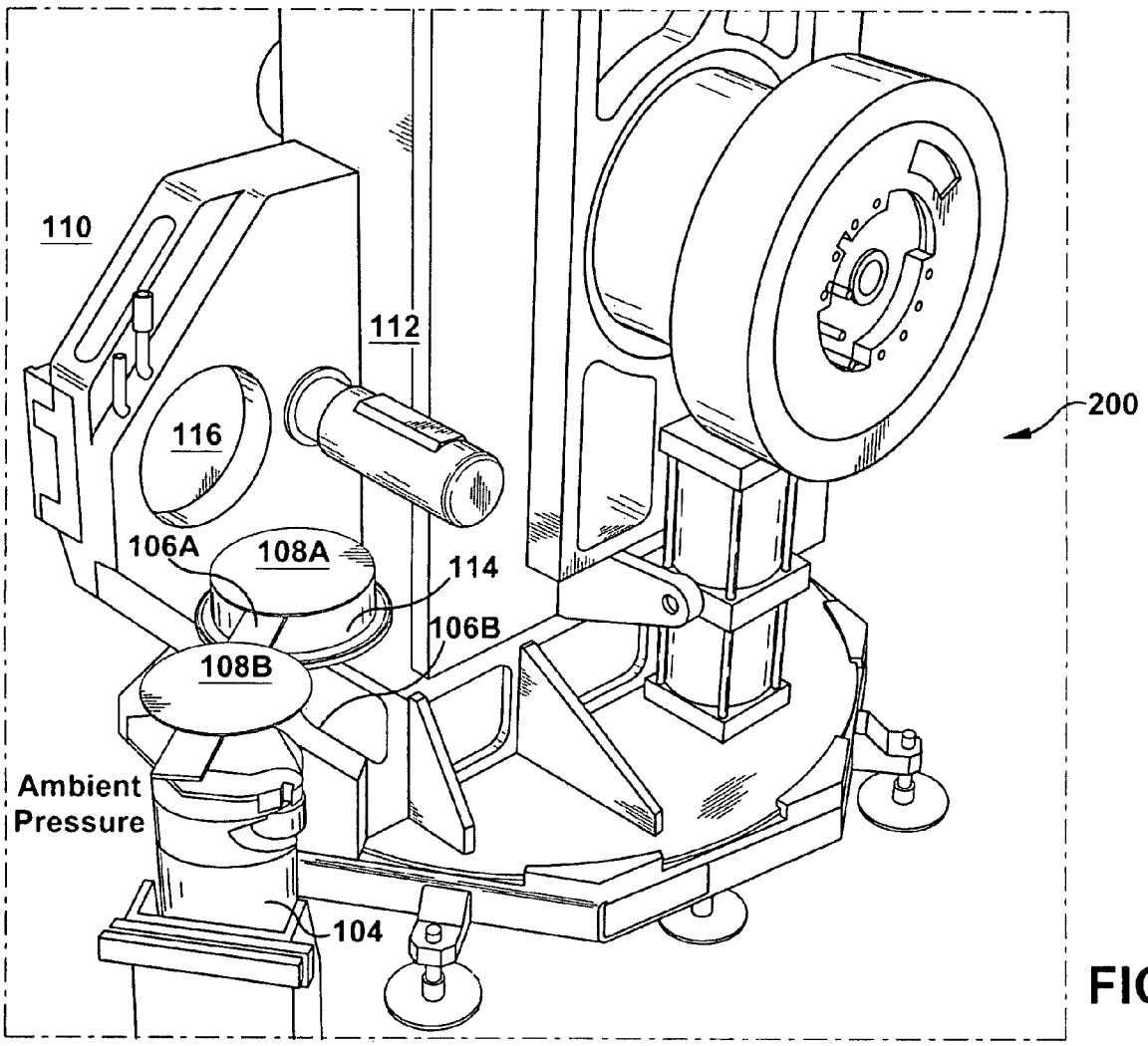
FIG. 2 illustrates another exemplary ion implantation system that includes a vacuum chamber in accordance with another aspect of the present invention.

FIG. 2 illustrates an ion implantation system 200 with a platen 114 that has been rotated from a vertical position into a horizontal position about a hinge so that a first wafer 108A can be removed from inside a load lock cavity 116. The wafer 108A is at ambient pressure as illustrated. The first wafer 108A (ion implanted) can be picked up with a first robotic arm 106A of a robot 104, for example and retracted away from the horizontal platen 114. A second robotic arm 106B can move the second wafer 108B (not yet implanted) over the platen 114 and release the second wafer 108B onto the platen 114. The robotic arms, 106A and 106B, can be translated and rotated by the robot 104. The first ion implanted wafer 108A can be subsequently placed in one of the storage pods 102 (FIG. 1), for example.

Figure 3:
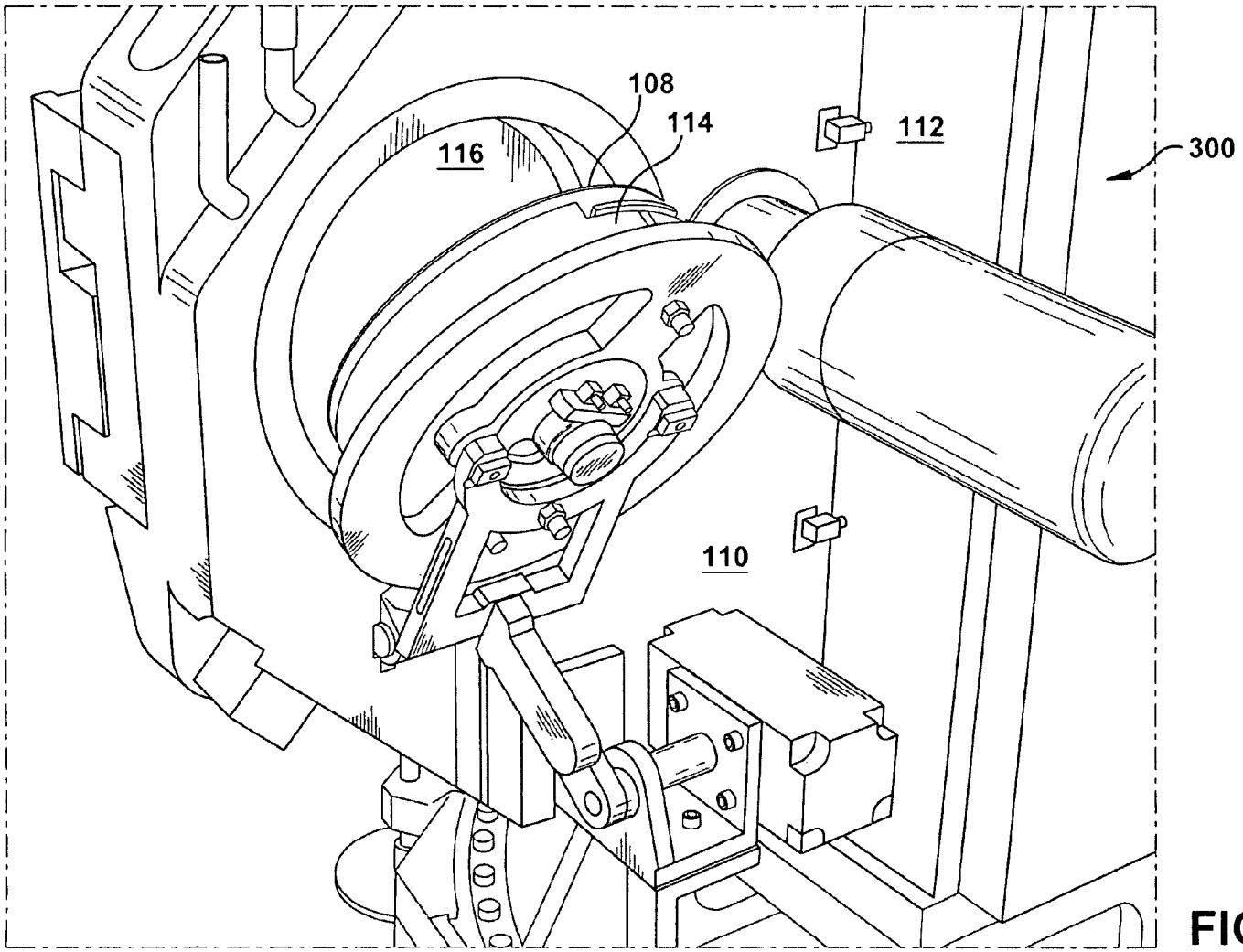
FIG. 3 illustrates yet another exemplary ion implantation system that shows the wafer being loaded in the vacuum load lock in accordance with another aspect of the present invention.
Figure 4:
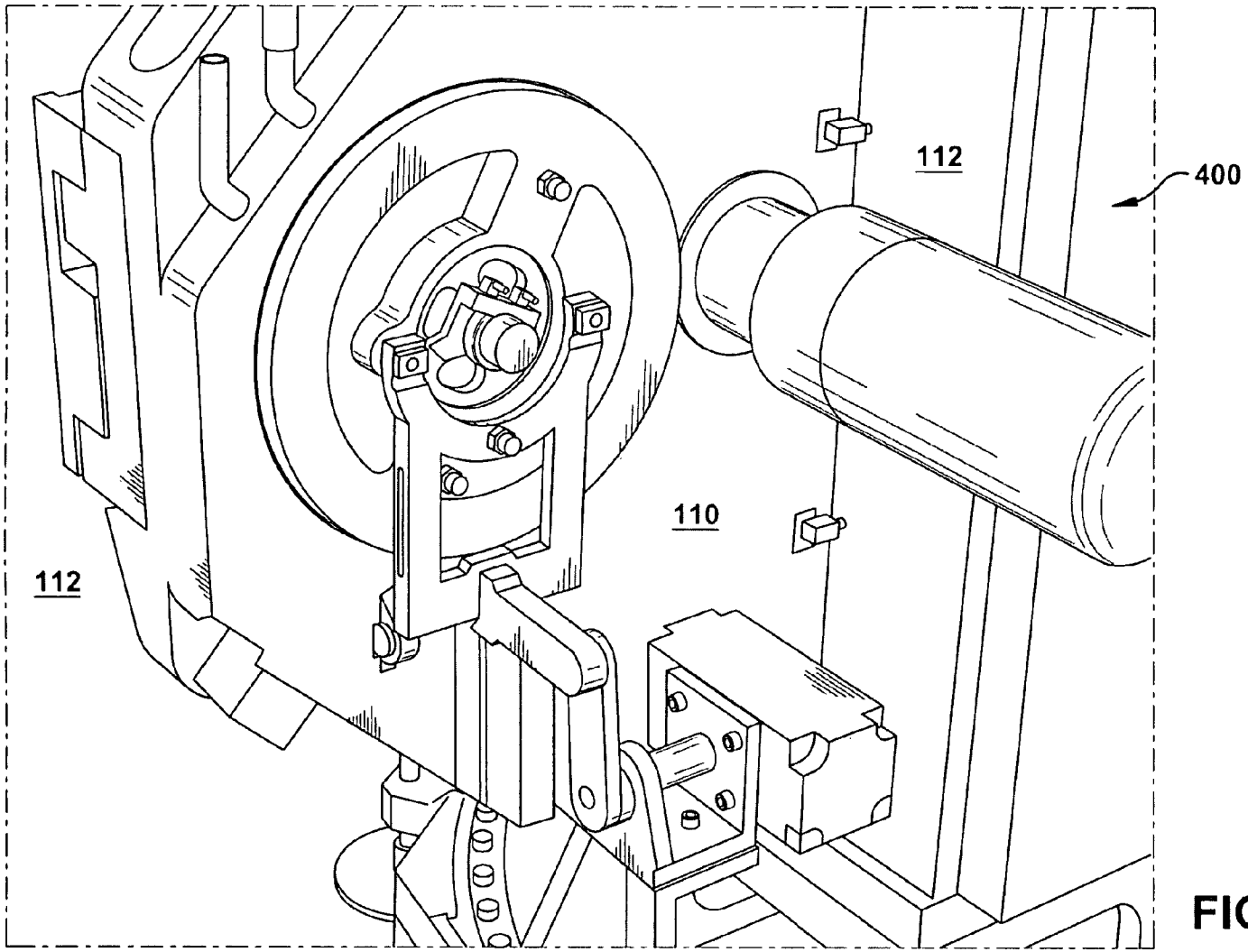
FIG. 4 illustrates an exemplary ion implantation system that shows the wafer loaded in the vacuum load lock in accordance with yet another aspect of the present invention.
Figure 5:
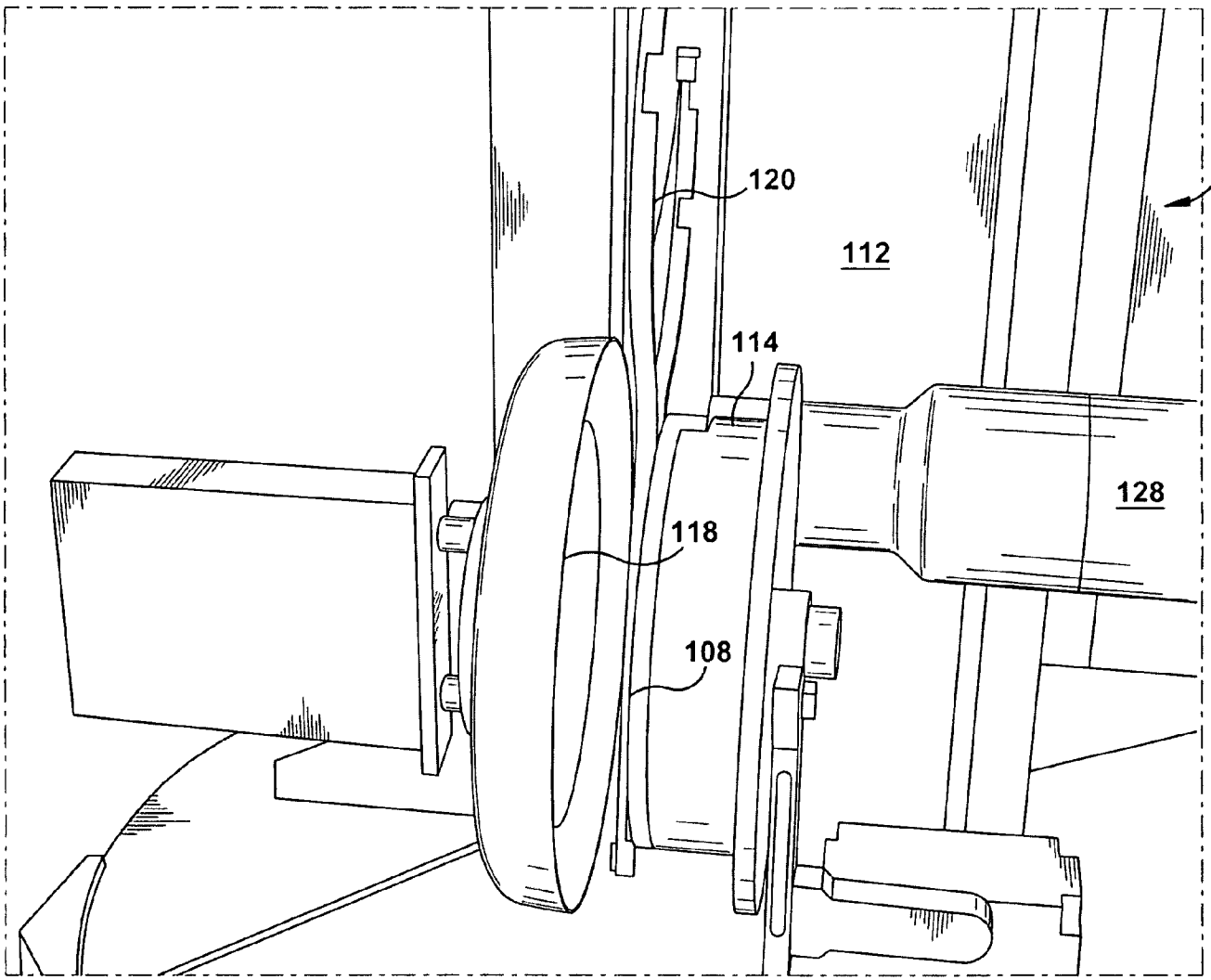
FIG. 5 illustrates an exemplary ion implantation system that shows the load lock removed for clarity to show the vacuum chamber in accordance with another aspect of the present invention.

Turning now to FIG. 3, an ion implantation system 300 is shown with a wafer 108 loaded on a platen 114 and rotated toward (as shown) the load lock cavity or chamber 116. FIG. 4 illustrates the platen 114 fully deployed or rotated into the load lock chamber 116 (FIG. 3). The load lock 112 as illustrated is sealed and can be fully evacuated by pulling vacuum on the chamber 116 (FIG. 3). FIG. 5 illustrates the ion processing chamber with a load lock 112 shroud (FIG. 3) removed from the illustration for clarity to illustrate the wafer 108 and a wafer transfer arm 120 inside the vacuum processing chamber 110, for example. The inventors recognized the advantage of utilizing passive tags on the transfer arm 120 due to the difficulty of supplying an RFID power source and wiring harness within the vacuum processing chamber 110. Harnessing the RFID sensor with a power supply would significantly increase the complexity of the remote wafer detection system when the RFID tag is in the vacuum chamber 110. Passive RFID tags don't need a power source, have an extended operational lifetime, are less costly than active tags, and the like.

Figure 6:
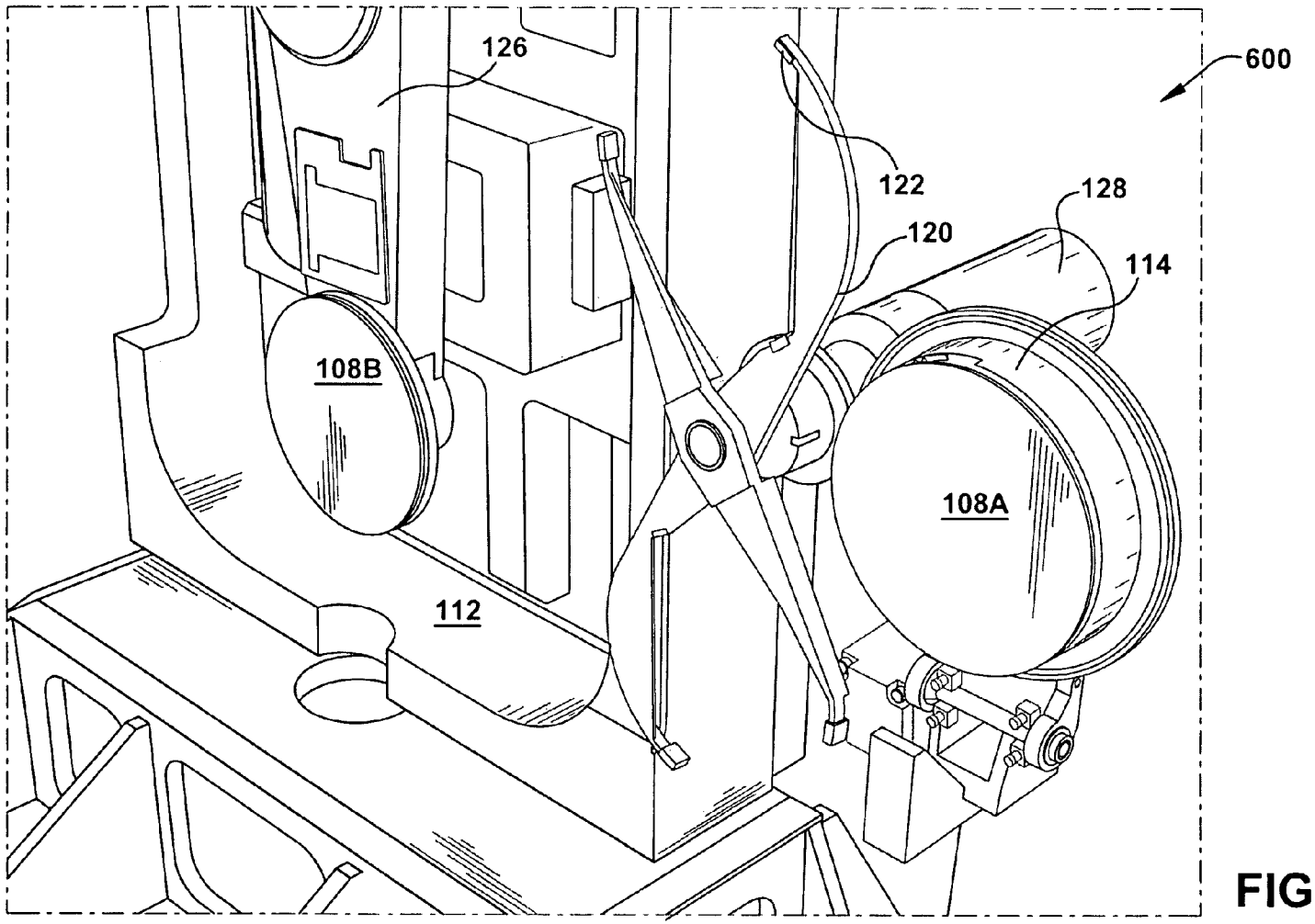
FIG. 6 illustrates an exemplary ion implantation system that includes a wafer transfer arm in accordance with an aspect of the present invention.
Figure 7:
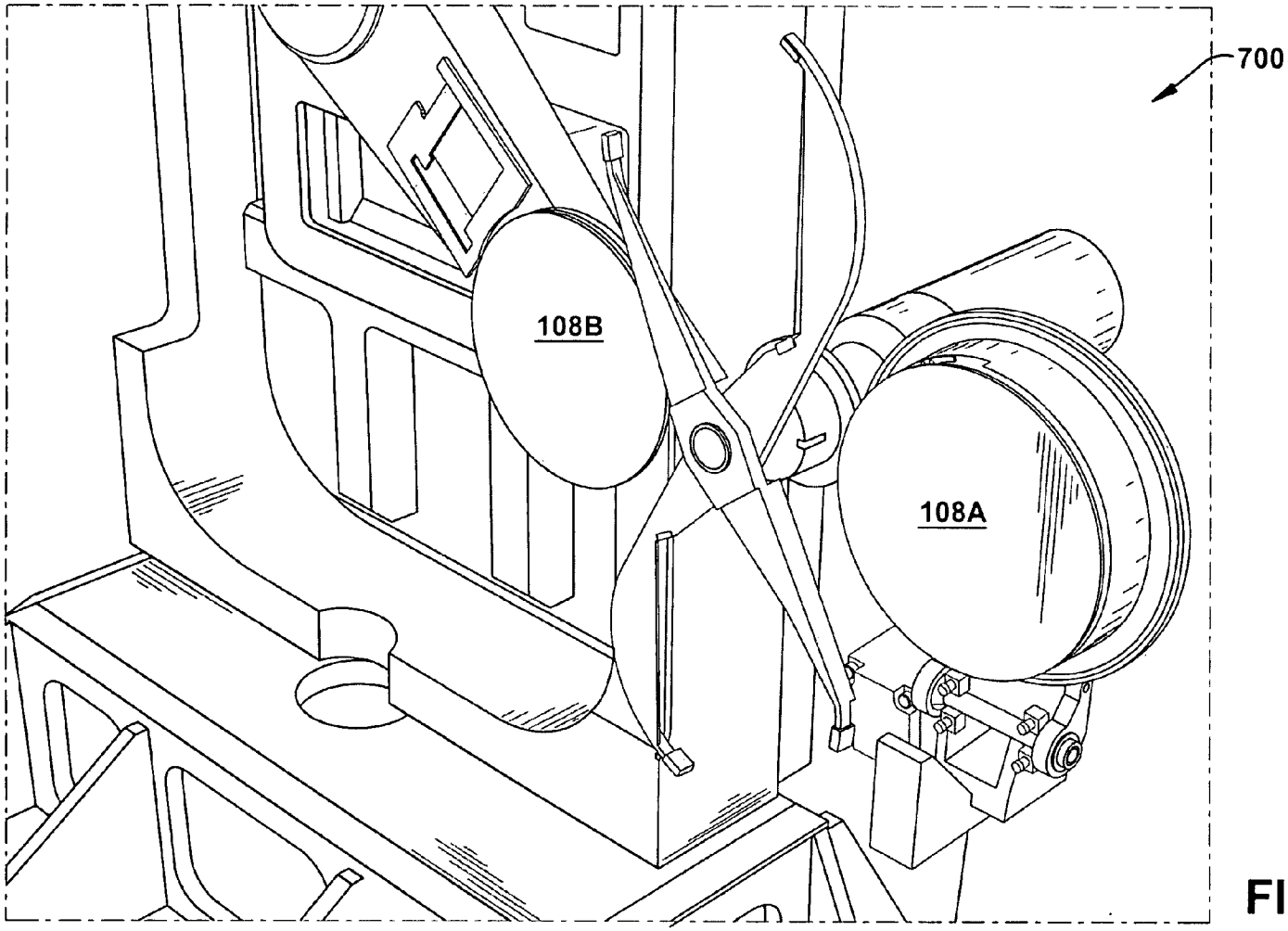
FIG. 7 illustrates a wafer transfer arm in accordance with an aspect of the present invention relating to an ion implantation system.

FIG. 6 illustrates an exemplary ion implantation system 600 with a transfer arm 120 within a vacuum chamber 110 (FIG. 1) for swapping an ion implanted wafer 108B with a non-implanted wafer 108A, for example. The inside of the vacuum chamber 110 is shown for clarity. The transfer arm 120 is rotated by a motor 128 and allows a wafer 108A to be gripped and rotated away from a platen 114. The platen 114 can be utilized for moving the wafer 108A from an EFEM into the vacuum chamber 112. The wafer pendulum arm 126 can rotate a wafer 108B for implanting and for transferring the wafer 108B to within the reach of the rotating transfer arm 120. FIG. 7 illustrates an ion implantation system 700 with some of the components shown in FIG. 6 fully removed for clarity, for example.

Figure 8:
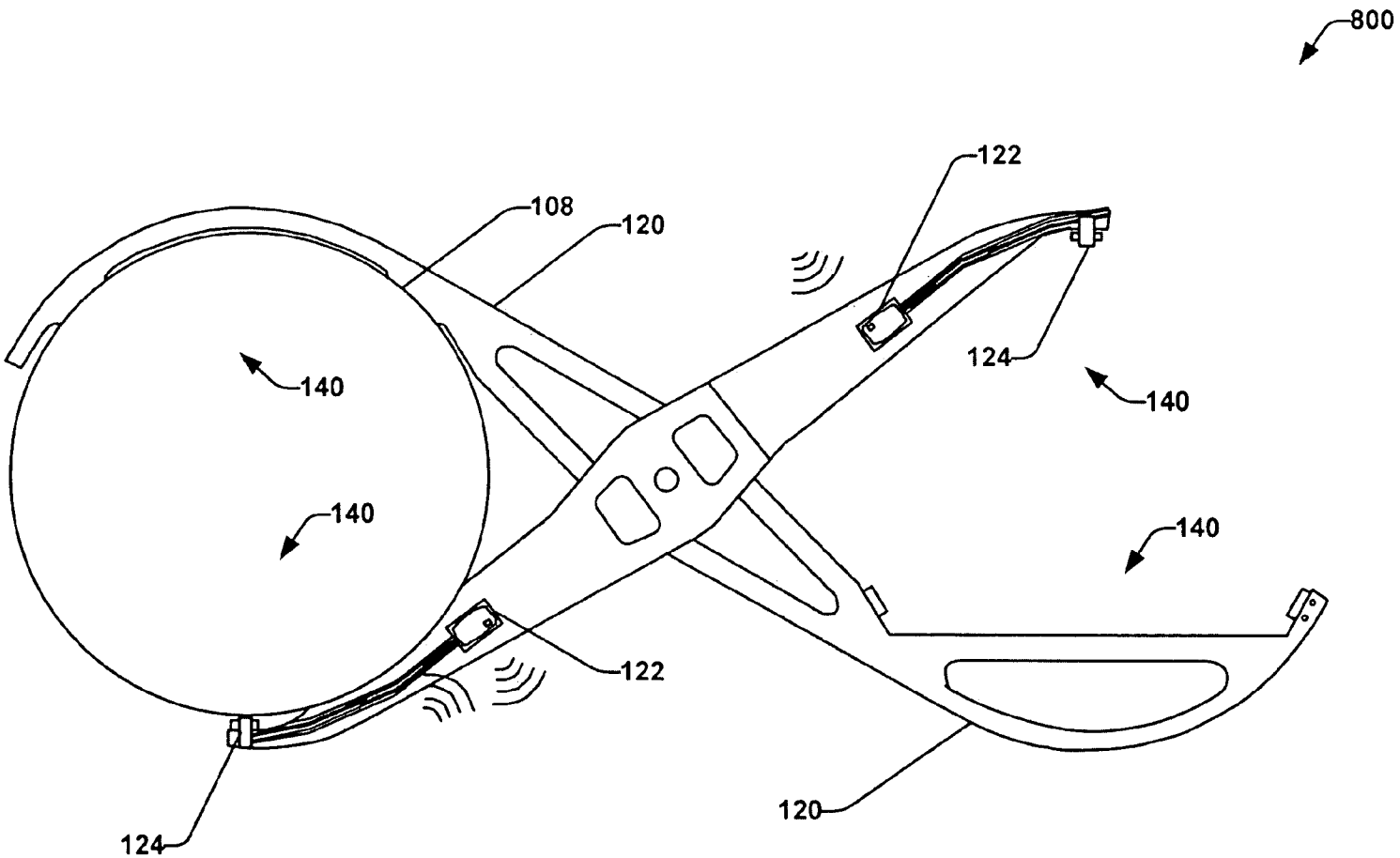
FIG. 8 illustrates a wafer held by a transfer arm of an ion implantation system in accordance with yet another aspect of the present invention.

FIG. 8 illustrates a transfer arm 120 with passive RFID tags 122 attached to the arms 120 and a micro-switch 124 that is wired to each of the tags 122, for example. In one embodiment the invention utilizes the passive RFID tag on each side of the transfer arm 120. When a wafer 108 is present and properly grasped by the transfer arms 120 the micro-switch 124 is closed completing the circuit and preventing the passive RFID tag 122 from being activated by the RFID reader (not shown). It will be appreciated that the RFID reader can also utilize an antenna inside the vacuum chamber 110 or in any other readable location within the ion implantation system 100 or any of its components therein.

Figure 9:
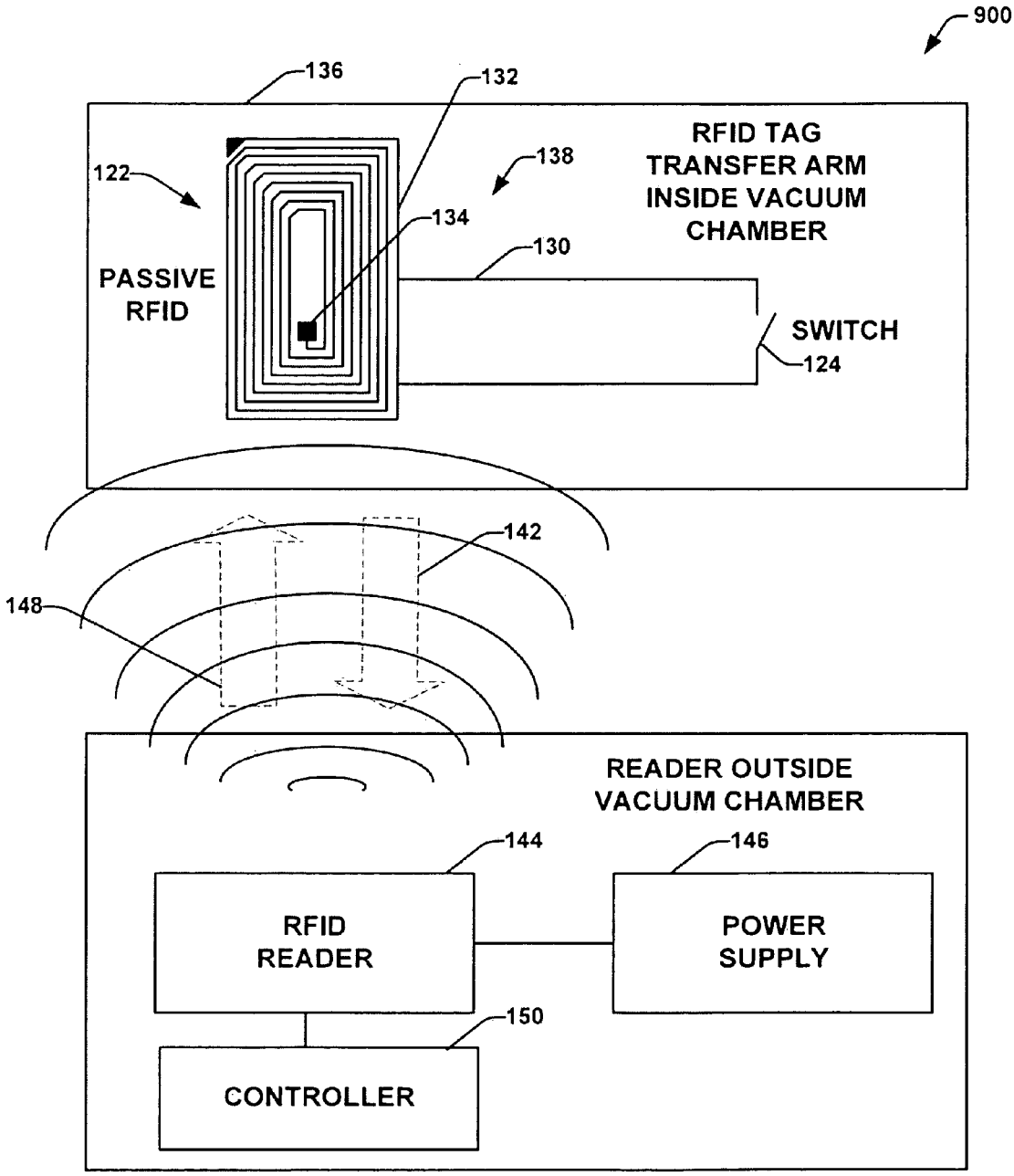
FIG. 9 illustrates an exemplary passive RFID remote wafer detection system within an ion implantation system in accordance with an aspect of the present invention.

FIG. 9 is a schematic block diagram of an RFID communication system 900 according to another aspect of the present invention. A passive RFID tag 122 comprises an antenna 132, a tag integrated circuit 134 and a substrate 136, for example. The passive RFID tag 122 does not contain a battery and/or a direct power source, rather the power is supplied by an RFID reader 144 in the form of RF signal energy 148. When radio waves 148 generated by the reader 144 are picked up by the passive RFID tag 122, the coiled antenna 132 within the tag 122 is "energized" and forms an electromagnetic field. The tag 122 draws power from it reader's electromagnetic field 148, energizing the coils 132 to power the RFID tag microprocessor which sends out a unique signal. The tag 122 then energizes and transmits the information encoded in the tag's memory, for example. Analog RFID tags 122 can be used in one embodiment, for example, to transmit position, force information, and the like, which can be utilized not only for wafer presence detection, but also wafer position measurement. Another embodiment of this invention utilizes the circuit commonly used in an electronic article surveillance system that is well known by ordinary skill in the art. The RFID tag can contain a diode, for example, that rectifies the induced signal and therefore generates harmonics of the induced signal. The mechanical switch mentioned supra can be used for bypassing the diode which would prevent the generation of the harmonics. In one embodiment a controller can monitor of the harmonics signal to determine the presence or absence of the wafer.

Radio frequency identification systems use radio frequency to identify, locate and track people, assets, and animals. Passive RFID systems 900 are composed of three components—the interrogator (reader) 144, the passive tag 122, and a host computer. The tag 122 is composed of the antenna coil 132 and the silicon chip 134 that can include basic modulation circuitry, non-volatile memory, and the like. The RF signal 148 is often referred to as a carrier signal. When the RF field passes through the antenna coil 132, there is an AC voltage generated across the coil 132. This voltage is rectified to supply power to the tag 122. The information stored in the tag 122 is transmitted back to the reader 144 often called backscattering, for example. By detecting the backscattering signal 142, the information stored in the tag 122 can be fully identified. The RFID reader 144 can be a microprocessor controller unit 150 comprising a wound output coil, detector hardware, comparators, and software designed to transmit energy to the tags 122 mounted on the transfer arm 120 (FIG. 8). The RFID reader 144 subsequently reads information in the form of a generated electromagnetic signal from the RFID tag 122. The reader 144 can have its own power supply 146 as illustrated in FIG. 9 outside the vacuum chamber.

Each of the RFID tags 122 connected with wiring 130 to a mechanical switch 124 shorts out the RFID circuit 138 when a wafer 108 in properly held by the transfer arm gripper 120. The shorted circuit 138 stops the current to the microprocessor 134, and therefore prevents the generation of the unique signal 142. This allows the use of the absence of this signal as the wafer 108 presence detection. Since each RFID tag 122 sends out a unique signal 142, multiple RFID tags 122 can be used. Gripping a wafer 108 can remove the short and allow the presence of the signal.

The system 900 can have three modes of operation, for example that are controlled by the controller 150, initialization and/or startup, normal operation, and termination. During initialization mode, the controller 150 causes the reader 144 to send interrogatory signals 148 requesting identification from the tags 122 via a reader antenna and a wireless communication medium, for example The interrogatory signals 148 may be sent in known frequency ranges. The controller 148 can be configured to read the tags signal 142 when the transfer arm 120 (FIG. 8) grasping a wafer present within the system 900. The passive tags 122 when energized transmit RFID signals 142 that can include wafer detection information and tag information, for example. The controller 150 can then determine wafers within the system and determine if wafers that should be detected and if those wafers are not detected the controller can shut down the system, alert the operator, etc.

During normal mode, the controller 150 periodically polls the tags 122 to reaffirm their presence and operation within the system 900. If an error is identified, the controller 150 can perform corrective action including shutting down the system, operating in a limited capacity, requesting service and/or replacement of affected wafers and/or components, notifying the operator, and the like. During termination mode, the controller 150 sends interrogatory signals 148 that include updated wafer and/or component information, such as throughput information. Other special modes, including programming modes, can also be present and employed within the system 900 in accordance with the present invention. A similar approach with switches and tags can be used within wafer pods 102 (FIG. 1) for determining if a wafer has been transferred to the load lock area, for example, and that the wafer should be detected in a subsequent operation involving the transfer arm.

Figure 10:
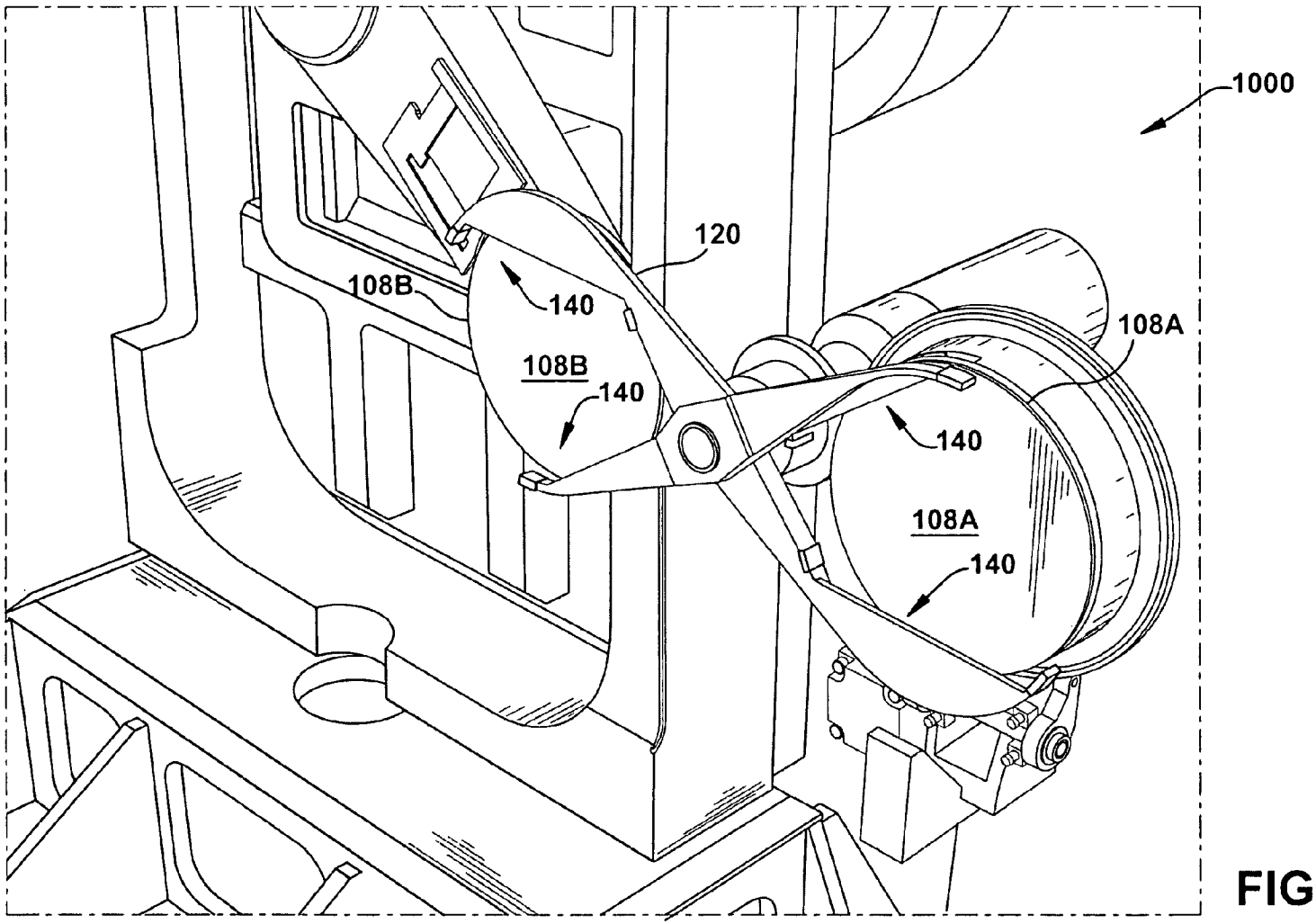
FIG. 10 illustrates an exemplary ion implantation system that includes a wafer transfer arm grippers rotated in close proximity to the wafers within the vacuum load lock in accordance with an aspect of the present invention.
Figure 11:
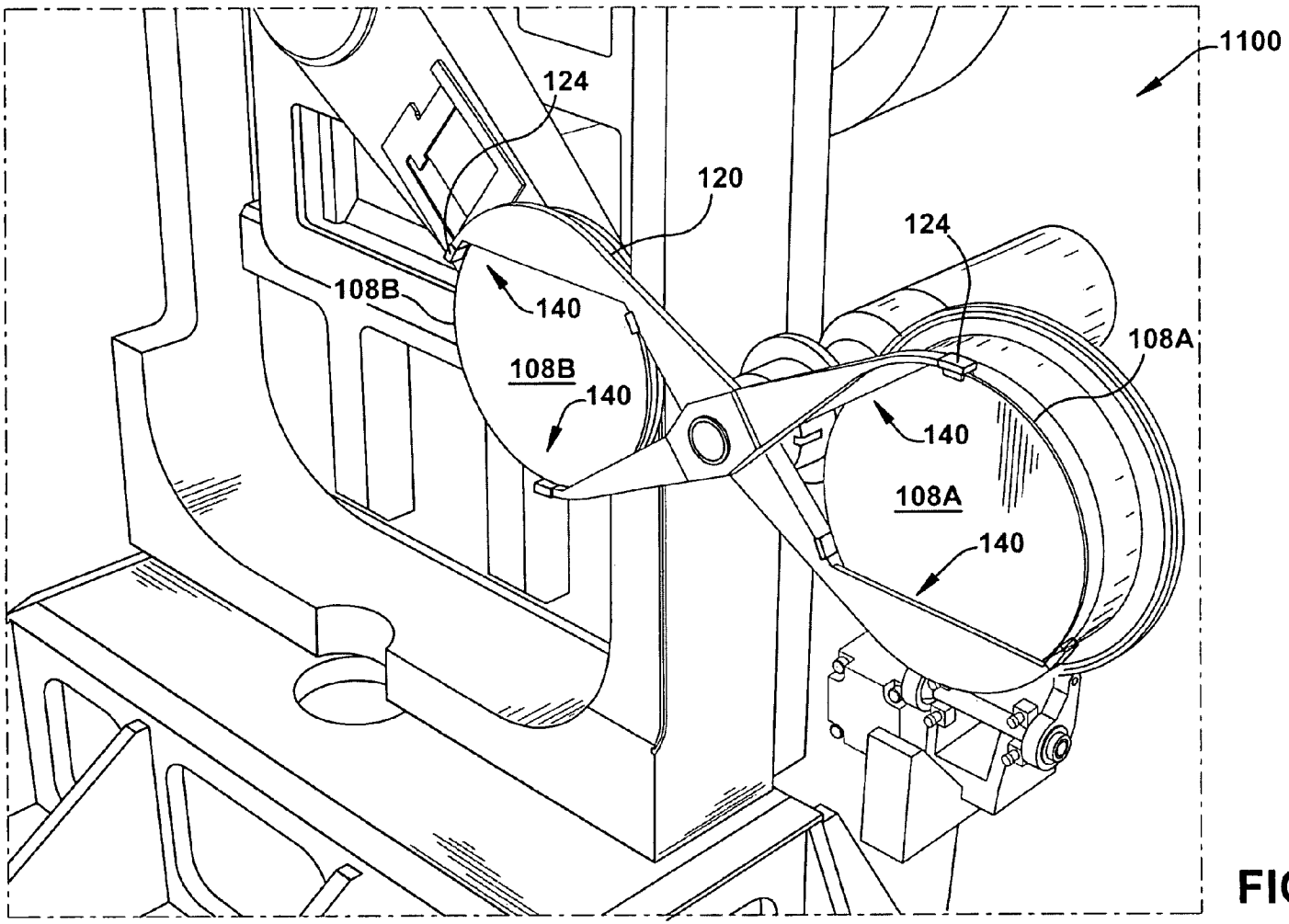
FIG. 11 illustrates exemplary ion implantation system in accordance with an aspect of the present invention.
Figure 12:
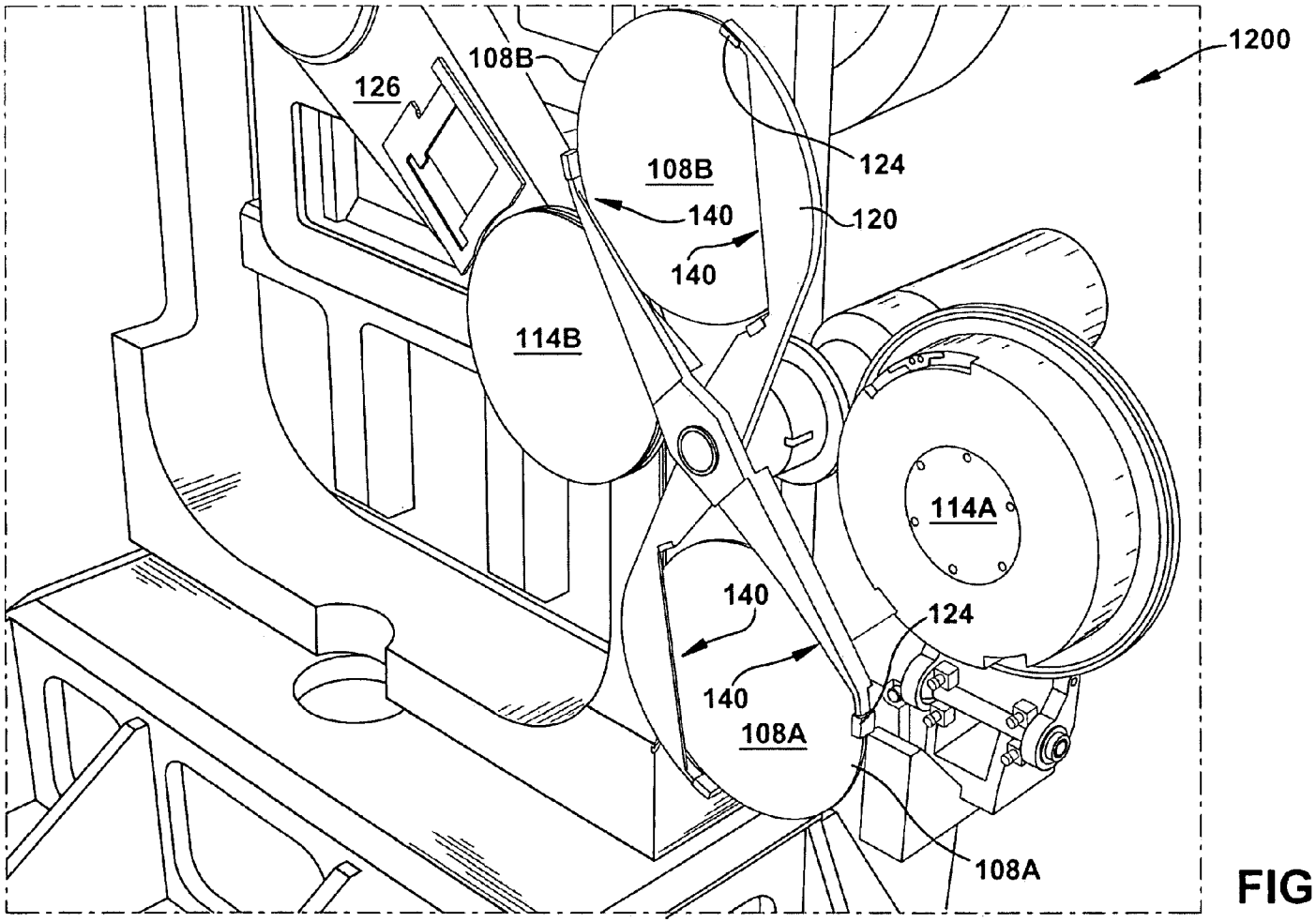
FIG. 12 illustrates an exemplary micro-switch circuit in accordance with an aspect of the present invention.

FIG. 10 illustrates a first wafer 108A and a second wafer 108B inside the vacuum chamber 110 with the outer walls of the chamber 110 removed for clarity. A transfer arm 120 can be rotated by a motor 128 so that grippers 140 are located in close proximity to the wafers 108A and 108B, wherein the grippers 140 are separated at a distance greater than the wafer diameter. As illustrated in FIG. 11 of the ion implantation system 1100 grippers 140 are translated and/or rotated so the wafers (108A and 108B) come into contact with and activate the micro-switches 124, for example. In one embodiment activating the switch can cause a short in the circuit interrupting a signal 142 (FIG. 9) transmitted by the tag 122 (FIG. 9). The controller 150 (FIG. 9) can then interpret the lack of signal 142 as the proper gripping of the wafer, for example. FIG. 12 illustrates another embodiment of the present invention, an ion implanting system 1200 where a first wafer 108A can be transferred to a second platen 114B and a second wafer 108B can be transferred to a first platen 114A, for example. In this embodiment the second wafer 108B has been ion implanted and the first wafer 108A has not been implanted. It should be appreciated that additional passive RFID tags can be utilized in the system, for example. It should be appreciated by one of skill in the art that in the alternative "activating" the switch removes the short. Additional micro-switches can be mounted to the platens (114A and 114B) and used with the passive tags to determine the presence of wafers on the platens. It should also be appreciated that a combination of active and passive RFID tags can be used inside and outside of the vacuum chamber 110, for example to track wafer movement, component translation and rotation, and the like. The implementation of active and passive systems is well known by those of ordinary skill in the art.

If one or more of the components are not authenticated, the controller can either halt operation or operate in a limited, safe mode, such as described in FIG. 5. Otherwise, the controller (not shown) operates the system 600 (FIG. 6) in normal mode, wherein the controller periodically polls the tags to reaffirm their presence and operation within the system 600. If an error is identified, the controller can perform corrective action including shutting down the system, operating in a limited capacity, requesting service and/or replacement of affected components, and the like. During termination mode, the controller sends interrogatory signals that include updated component information, such as usage information. Other special modes, including programming modes, can also be present and employed within the system 600 in accordance with the present invention.

Figure 13:
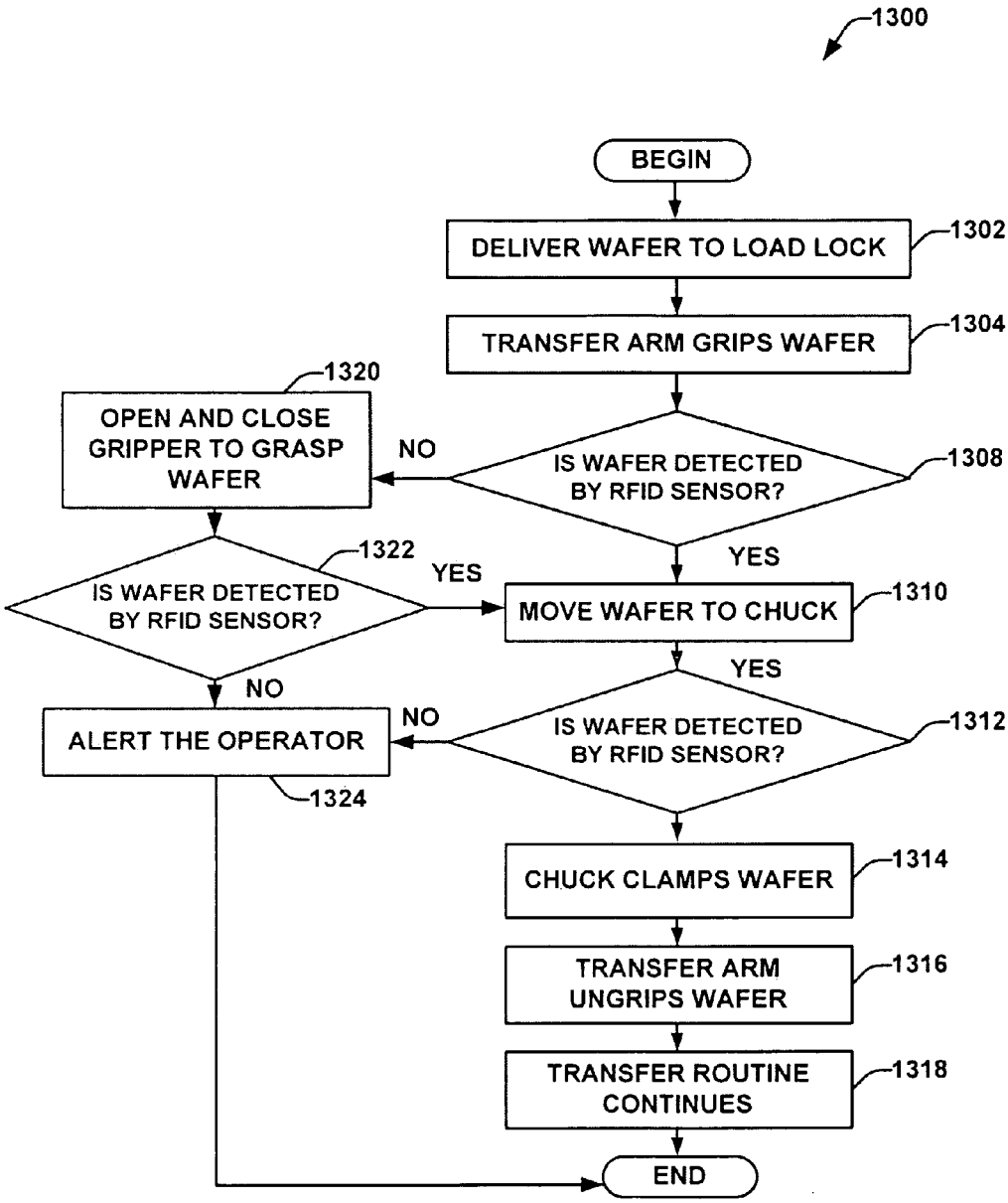
FIG. 13 illustrates an exemplary flow diagram for a wafer detection system in accordance with an aspect of the present invention.

FIG. 13 is a flow diagram illustrating a method 1300 of managing wafers and/or components, including parts and subsystems, within a system in accordance with an aspect of the present invention. The method 1300 identifies wafers and/or components installed, uninstalled, and remaining within the system. Additionally, the method 1300 correlates performance of the system with the identified components to determine if replacement and/or repair of one or more components is desired. The system 1300 generally performs a task or operation and comprises a number of components, including parts and/or subsystems. An example of a suitable system is an ion implantation system, such as the system described in FIG. 12.

The method 1300 begins at block 1302, wherein a wafer is delivered to a load lock in the ion implantation system. The wafer is delivered or transferred by robot with robotic arms or another automated delivery subsystem within the system. The one or more passive RFID tags can be associated with wafers and/or components in the system. In one embodiment, a micro-switched active RFID tag circuit can be used to determine whether the wafer has been properly placed on a platen prior to be loading into the load lock, for example. One or more readers located outside a vacuum chamber can typically transmit the identification request signal to the one or more tags via a wireless communication medium, for example.

A vacuum is created within the sealed load lock chamber, wherein the transfer arm grips the wafer at 1304. The RFID response signal can be interrupted at if a micro-switch 130 is closed thereby shorting out a passive RFID tag circuit 138 such as that shown in FIG. 9, for example. The response signals can be generated by the one or more tags and transmitted to the one or more readers via the wireless communication medium. The passive tags within the vacuum chamber do not require a battery and/or power supply to operate. Rather, the passive RFID tags are energized by the signal generated by the reader, as discussed supra. It should be understood by one of skill in the art that the RFID response can be detected (i.e., the switch opens) or the RFID response can be interrupted when the wafer is detected, and the like and all such embodiments are incorporated herein.

If a wafer is detected at 1308 then the transfer arm is rotated which rotates the wafer from a first platen to a second platen or wafer chuck at 1310, for example. The system again determines at 1312 if the wafer is present at the chuck using a passive RFID circuit as described supra. If the wafer is determined the chuck clamps the wafer at 1314. The wafer transfer arm un-grips the wafer at 1316 and the transfer routine continues at 1318 where after the routine is completed the method ends.

Otherwise, if the wafer is not detected at 1308, the method 1300 continues to block 1320 wherein the gripper is opened and closed in an attempt to grasp the wafer. If the wafer is not detected at 1322, an operator can be alerted at 1324 or the system can be switched to safe mode or shutdown, for example. At 1324 the wafer ion implantation system can require a corrective action before the system is continued, for example.

Although the invention has been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising."

What is claimed is:

1. A system for remotely detecting the presence of a wafer comprising:

a passive RFID circuit, wherein the RFID circuit is operably coupled to a wafer gripper located at an end of a transfer arm located inside a vacuum chamber of an ion implantation system;

a reader located outside the vacuum chamber and configured to transmit wirelessly an interrogation signal to the passive RFID circuit; and wherein the passive RFID circuit provides an indication relating to whether or not a wafer is secured by the wafer gripper in response to the interrogation signal.

2. The system for remotely detecting the presence of a wafer of claim 1, wherein the reader generates an RF interrogation signal.

3. The system for remotely detecting the presence of a wafer of claim 1, wherein the passive RFID circuit comprises: wiring, a passive RFID tag and a micro-switch, wherein the wiring electrically connects together the passive RFID tag and the micro-switch, and wherein the micro-switch is configured to close and alter a response of the passive RFID tag in response to the interrogation signal when the wafer is secured by the wafer gripper.

4. The system for remotely detecting the presence of a wafer of claim 3, wherein the passive RFID circuit transmits a response signal when activated by the interrogation signal transmitted by the reader when the micro-switch is open in the circuit when a wafer is not present at the wafer gripper.

5. The system for remotely detecting the presence of a wafer of claim 1, further comprising a controller and a power supply coupled to the reader, wherein the controller detects the presence of the wafer based upon a response signal generated by the passive RFID circuit in response to the interrogation signal.

6. The system for remotely detecting the presence of a wafer of claim 1, wherein the ion implantation system comprises an equipment front end module, the vacuum chamber, a load lock and the transfer arm.

7. The system for remotely detecting the presence of a wafer of claim 5, wherein the controller obtains wafer presence information from the response signal and selects a mode of operation of the ion implantation system according to the wafer presence information.

8. The system for remotely detecting the presence of a wafer of claim 1, wherein the response signal comprises tag information, force information, or position information.

9. A method of detecting wafer presence within a system comprising:

delivering a wafer to a load lock in an ion implantation system;

gripping the wafer with a transfer arm;

generating a first signal in a passive RFID tag induced by a reader component indicating the gripping of the wafer;

moving the wafer to a chuck if the first signal is generated;

generating a second signal in the passive RFID tag induced by the reader component indicating proximity to the chuck upon moving the wafer to the chuck;

clamping the wafer to the chuck if the second signal is generated; and releasing the wafer from the transfer arm after clamping the wafer to the chuck.

10. The method of claim 9, wherein the reader generates an RF signal.

11. The method of claim 9, wherein the passive RFID tag comprises an antenna coil, a microprocessor and a substrate.

12. The method of claim 9, wherein the reader component is located outside the ion implantation system vacuum chamber.

13. The method of claim 9, wherein the transfer arm with an attached passive RFID tag is located inside the vacuum chamber.

14. The method of claim 9, wherein the ion implantation system comprises an equipment front end module, a vacuum chamber, a load lock and a transfer arm.

15. A remote wafer detection system, comprising:

a passive RFID circuit, wherein the RFID circuit is operably coupled to a wafer gripper located at an end of a transfer arm located inside a vacuum chamber of an ion implantation system;

a reader located outside the vacuum chamber and configured to transmit wirelessly an interrogation signal to the passive RFID circuit; and wherein the passive RFID circuit provides a response signal related to whether or not a wafer is properly gripped by the wafer gripper in response to the interrogation signal.

16. The system of claim 15, wherein the reader generates an RF interrogation signal.

17. The system of claim 15, wherein the passive RFID circuit comprises: wiring, a passive RFID tag and a micro-switch, wherein the wiring electrically connects together the passive RFID tag and the micro-switch, and wherein the micro-switch is configured to close and alter a response of the passive RFID tag in response to the interrogation signal when the wafer is gripped by the wafer gripper.

18. The system of claim 15, wherein the passive RFID circuit transmits the response signal when activated by the interrogation signal transmitted by the reader when a micro-switch is open in the circuit when a wafer is not present.

19. The system of claim 15, wherein the passive RFID circuit is inactivated when a micro-switch is closed by gripping of the wafer.

20. The system of claim 15, further comprising a controller and a power supply coupled to the reader, wherein the controller remotely detects the presence of a wafer based upon the response signal generated by the passive RFID circuit.

21. The system of claim 15, wherein the ion implantation system of comprises an equipment front end module, the vacuum chamber, a load lock and the transfer arm.

22. The system of claim 20, wherein the controller obtains wafer presence information from the response signal and selects a mode of operation of the ion implantation system according to the wafer presence information.

23. The system of claim 15, wherein the response signal comprises tag information, force information, or position information.

24. The method of claim 9, further comprising:

opening and closing the transfer arm if the first signal is not generated.

25. The method of claim 9, further comprising:

alerting an operator if the second signal is not generated.

* * * * *